US006568003B1

(12) United States Patent
Vest

(10) Patent No.: US 6,568,003 B1
(45) Date of Patent: May 27, 2003

(54) DEVICE FOR HANDLING A PATIENT

(75) Inventor: Jan Erik Vest, Barrit (DK)

(73) Assignee: Ropox A/S, Naestved (DK)

( * ) Notice: Subject to any disclaimer, the term of this patent is extended or adjusted under 35 U.S.C. 154(b) by 0 days.

(21) Appl. No.: 09/697,732

(22) Filed: Oct. 26, 2000

(30) Foreign Application Priority Data

Mar. 31, 2000 (EP) ..... 00201163

(51) Int. Cl.[7] ..... A61G 7/10
(52) U.S. Cl. ..... 5/89.1; 5/81.1 R
(58) Field of Search ..... 5/89.1, 81.1 R, 5/83.1

(56) References Cited

FOREIGN PATENT DOCUMENTS

| | | |
|---|---|---|
| DE | 4233328 C1 | 11/1993 |
| FR | 2403074 | 4/1979 |
| WO | WO 95/16825 | 6/1995 |
| WO | WO 95/18592 | 7/1995 |
| WO | WO 96/11658 | 4/1996 |
| WO | WO 96/28126 | 9/1996 |
| WO | WO 97/30675 | 8/1997 |

*Primary Examiner*—Alexander Grosz

(74) *Attorney, Agent, or Firm*—Altera Law Group LLC

(57) ABSTRACT

The invention relates to a device for handling a patient, such as raising a patient from a sitting position to a standing position or vice versa, and/or moving the person from one location to another, said device comprising top mounting means (51, 52) for suspending the device from suspension means (5), and frame means (1, 2, 3) for supporting the patient, the frame means comprising a supporting lower frame portion (2) comprising a feet support assembly (6) and a knee support (7), an upper frame portion (1) comprising the mounting means (51, 52) and means (12) for attaching a sling (9), and an intermediate frame linkage portion (3) connecting the upper and lower frame portions (1, 2) in such a way that the upper frame portion (1) is vertically moveable in relation to the lower frame portion (2).

Figure 1:
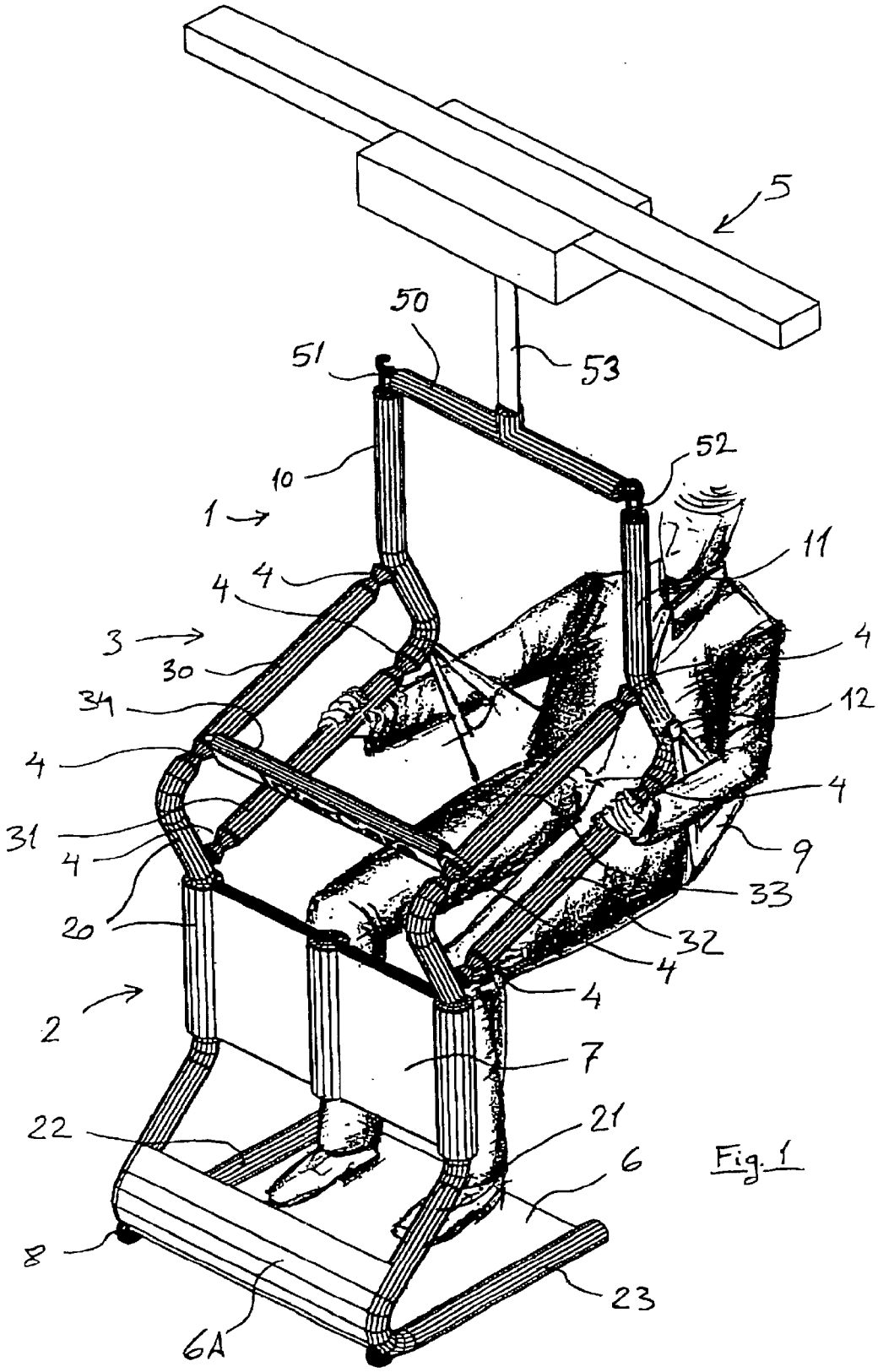

By the invention, a simple, robust and reliable device for use in a hoist is provided which is designed to be operated by suspension means at the top or provided with an actuator so that the device constitutes the hoist. The operation principle is that a patient is placed in the device and then raised to standing position or vice versa by lifting—respectively lowering—of the entire hoist device whereby the relative position of the upper and lower frame portions is altered due to the intermediate frame linkage portion. A device according to the invention may be used together with virtually all types of lifting mechanisms as it is attachable to a lift structure at the top mounting means of the device.

16 Claims, 4 Drawing Sheets

DEVICE FOR HANDLING A PATIENT

The present invention relates to a device for handling a patient, such as moving the patient from one location to another in a hoist, said device comprising top mounting means for suspending the hoist from suspension means, and frame means for supporting the patient.

A hoist for handling a patient, such as moving the person from one location to another is known from WO 97/30675. These hoists are used for moving the person from one location to another by lifting the person up and moving the person along a predetermined track in the ceiling or the like. Other examples of such kinds of hoists are known from e.g. WO 95/16825, DE 42 33 328 C1 and FR-A-2 403 074.

A different type of hoist is known from e.g. WO 95/18592, where the patient is suspended from a lifting lever in a sling. The lever is moveable in a vertical direction and arranged on a chassis provided with wheels, so that the hoist can be used for moving the patient from one location to another. Moreover, this kind of hoist can be used for raising a patient from a sifting to a standing position and vice versa. This makes the hoist suitable for lifting a patient up from a wheel chair, a bed or the like. However, this kind of hoist is limited in use, due to the space is takes up around the point of use.

A device for use in an invalid hoist suspended from the ceiling or the like is limited to movements along a predetermined track. However, such tracks are mounted in accordance with the interior decoration and arrangement of the facilities where the hoist is to be used. Suspended hoists are easy to operate for the personnel. Another advantage is that no internal energy source is needed as is the case with the chassis type hoist.

A drawback of the suspended hoists known in the prior art is that none of the known hoists are usable for raising a physically disabled person from a sitting to a standing position, and it is the object of the present invention to provide a device for suspension in suspension means, such as a ceiling track or the like, that has the additional possibility of raising and lowering disabled persons from a sitting to a standing position and vice versa Another object is to provide a simple and robust design of a device for use as a suspension hoist of the initially mentioned kind.

The invention consists of a device of the initially mentioned kind, wherein the frame means comprises a supporting lower frame portion comprising a feet support assembly and a knee support, an upper frame portion comprising the mounting means and means for attaching a sling, and an intermediate frame linkage portion connecting the upper and lower frame portions in such a way that the upper frame portion is vertically moveable in relation to the lower frame portion.

By the invention, a simple, robust and reliable device for use in a hoist is provided which is designed to be operated by suspension means placed above the device. The operation principle is that a patient is placed in the device and is then raised to standing position or vice versa by lifting—respectively lowering—the entire hoist device whereby the relative position of the upper and lower frame portions is altered due to the intermediate frame linkage portion.

A device according to the invention and used in a hoist has the advantage that no internal energy source is needed as the power required for operating the hoist is provided by the power for lifting the hoist and patient. This power is supplied by the suspension means. This results in a wide range of use of a hoist according to the invention. Thus, a device according to the invention can be used together with virtually all types of lifting mechanisms as it is attachable to a lift structure at the top mounting means of the device.

In the preferred embodiment of the invention, the frame linkage portion comprises at least one H- or U-shaped frame portions comprising a right and a left bar portion. Hereby, the frame means is provided with good stability qualities in the sideways direction. The ends of the right and the left bar portions are preferably joined with the lower and the upper frame portions, respectively. Moreover, the ends of the respective frame portions are preferably provided with universal joints for linking the portions together. Hereby, a flexible and robust connection of the frame portions is established.

In the preferred embodiment of the invention, the link frame portion is designed as a parallelogram suspension allowing for a parallel movement between the lower frame portion and the upper frame portion. Hereby, a linkage between the upper and lower frame portions is obtained that allows for movement in the vertical direction but is resistant to movements in other directions.

In an embodiment of the invention, the feet support assembly comprises a foot rest plate and support roller means, such as a pair of wheels, disposed at the lowermost end of the lower frame portion for supporting the device. Hereby, the hoist device can be supported at the bottom while it is being moved with or without a person suspended in the hoist.

In a preferred embodiment, the knee support is at least vertically adjustable. Hereby, the device can be accommodated to fit persons of different sizes. Apart from a vertical adjustment, a horizontal adjustment may also be provided.

In a preferred embodiment, the supporting lower frame portion may comprise a left and a right bar portion. The two bar portions could be constituted by a U-shaped frame bar, but could alternatively be two bars in a suitable shape which are mutually assembled by suitable means. The feet support and/or the knee support could preferably be attached between the two bar portions in order to connect the two bars of the lower frame.

The upper frame portion could be provided with hand grips between the top mounting means and the means for attaching a sling. In another embodiment, the hand grips are integrally formed by suitable bending of the upper frame bars. Either way, by this arrangement of the hand grips and the sling attachment, an ergonomically sound position of the patient to be raised and transported is ensured.

Moreover, the top mounting means and/or means for attaching a sling could comprise attachment fittings at the top and the rear side of the upper frame portion, respectively.

In the preferred embodiment, the upper frame portion comprises two side bars. Hereby, a particularly simple design may be provided, and it is realised that the upper frame may comprise two separate parts that are both linked to the linkage frame portion and thereby held together.

The device is suspended from suspension means. These suspension means could typically comprise operating means, including a winch for raising and lowering the hoist and ceiling mounted track means in such a way that the hoist is movable in the track. A device according to the invention may hereby be used in a predetermined track system, such as an already mounted guiding rail, with only minor adaptations.

In another embodiment, the hoist device is suspended from suspension means comprising a lifting lever with means for receiving the top mounting means of the device, said lifting lever being arranged in a vertically moveable manner in a chassis. Hereby, a device according to the invention can be used in connection with a lifting arrangement, such as existing lifting devices, for raising a patient from a sitting to a standing position and vice versa.

The chassis could preferably be provided with support wheels allowing for the hoist to be moved from one location to another while being suspended in the chassis.

In another embodiment of the invention, a hoist is provided with a device for handling a patient, such as raising a patient from a sitting position to a standing position or vice versa, and/or moving the person from one location to another, said device comprising frame means for supporting the patient, said frame means comprising a supporting lower frame portion comprising a feet support assembly and a knee support, an upper frame portion comprising the mounting means and means for attaching a sling, and an intermediate frame linkage portion connecting the upper and lower frame portions in such a way that the upper frame portion is vertically moveable in relation to the lower frame portion, wherein the linkage frame portion in the device could be provided with an actuator, such as a linear or rotary actuator, for raising and lowering of the upper frame in relation to the lower frame.

Hereby, a device according to the invention can be used as a self-standing hoist, since the actuator will be able to supply the necessary movements for raising and lowering of the patient. Moreover, a hoist according to this embodiment of the invention could be provided with a source of energy, so that it can be operated independently of energy sources in e.g. rooms with no electricity. The hoist is preferably provided with wheels under the feet support assembly so that the hoist can be moved.

Furthermore, the invention relates to a method of handling a patient, such as raising a patient from a sitting position to a standing position, using a hoist according to the first aspect of the invention, wherein the upper and lower frame portions of the hoist are displaced in a generally vertical direction in relation to each other by lifting the entire hoist whereby the patient is raised.

Figure 2:
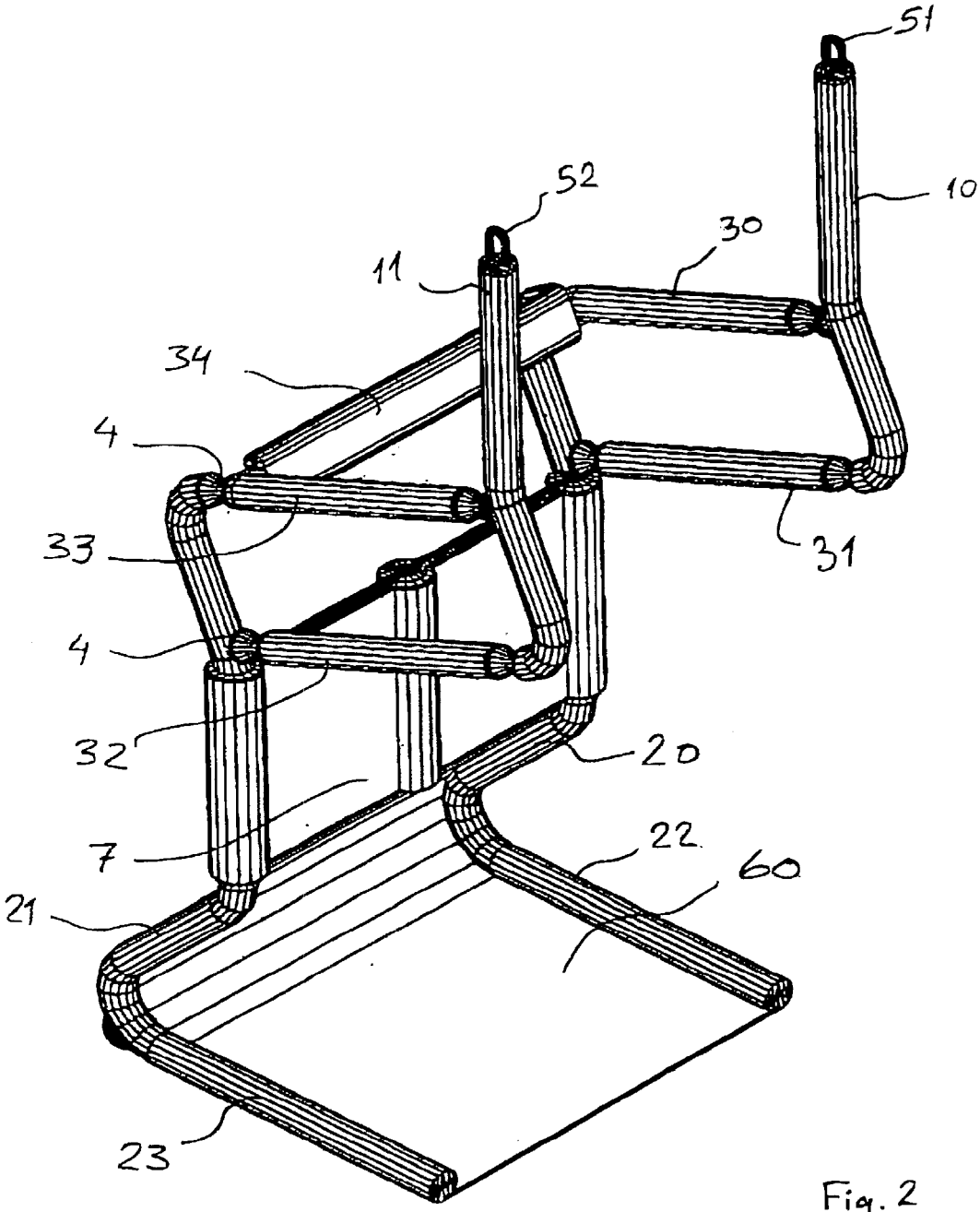
Figure 3:
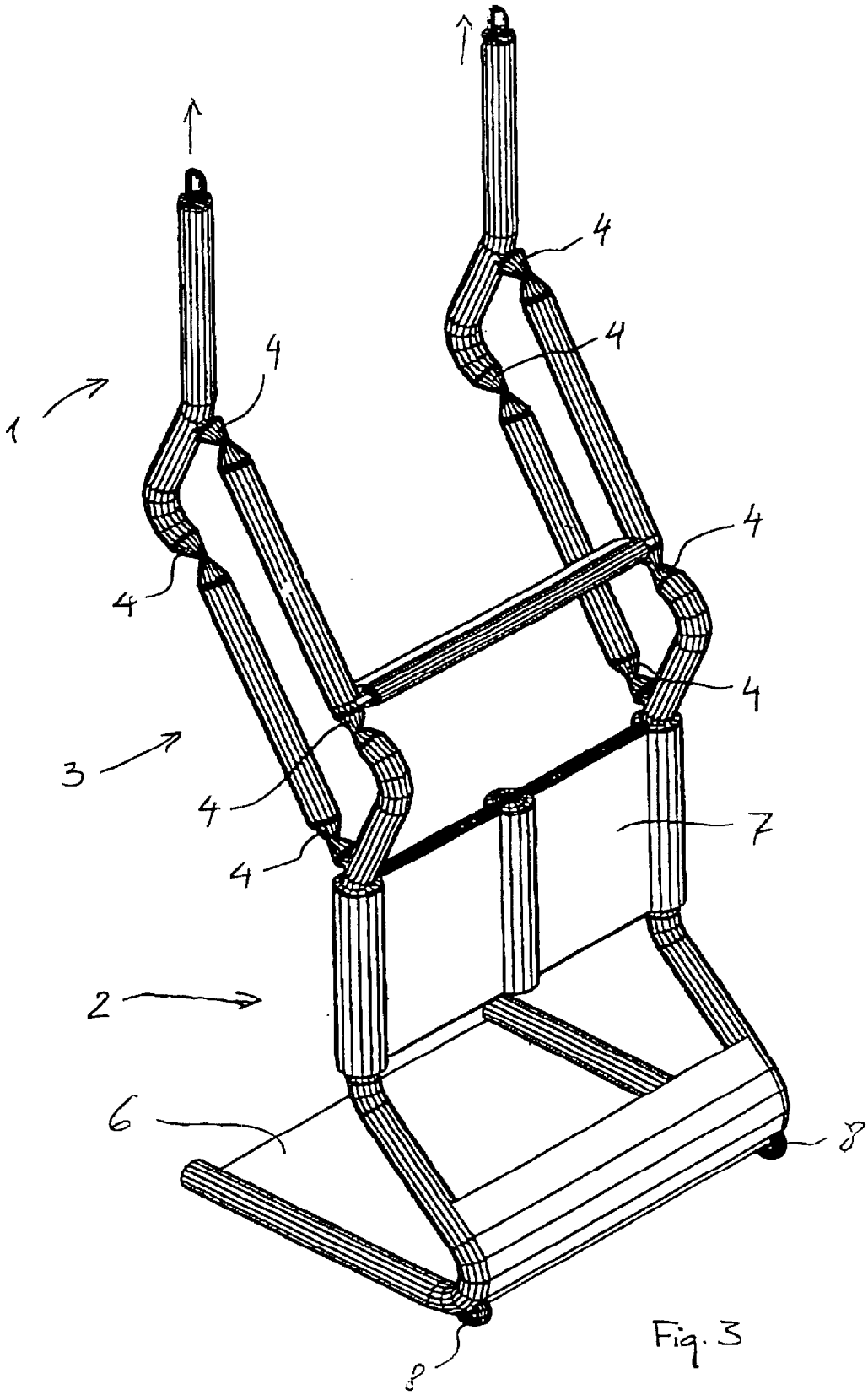
Figure 4:
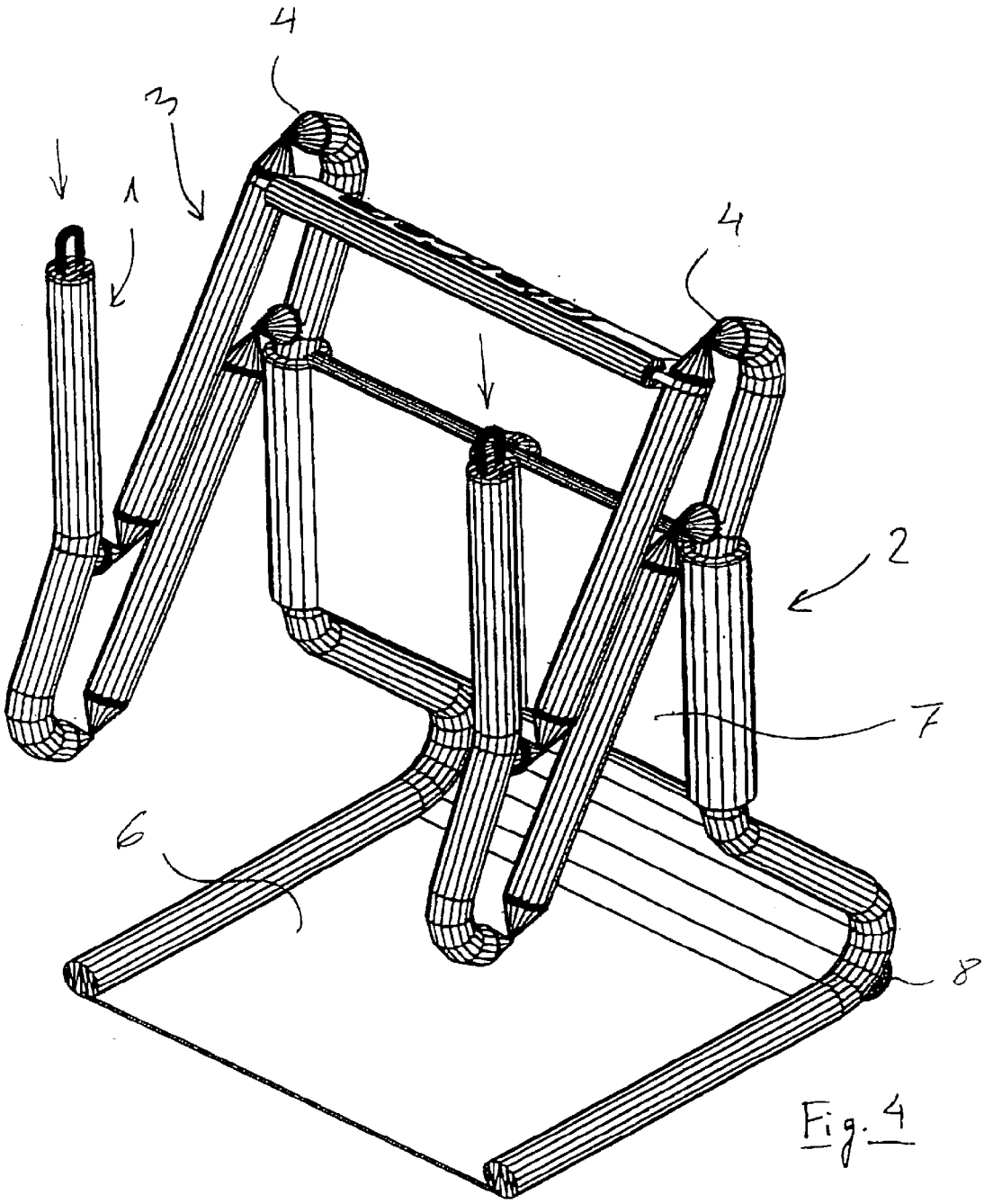

The invention will be described in detail below with reference to the accompanying drawings, in which FIG. 1 is a perspective view of a device for use in a hoist according to a preferred embodiment of the invention, FIG. 2 shows the same in another perspective view, and FIGS. 3 and 4 show the hoist device in a raised and a lowered position, respectively.

A device according to the invention for use as a hoist is shown in FIG. 1. The device comprises an upper frame portion 1 and a lower frame portion 2. These two frame portions 1 and 2 are linked together by a link frame portion generally referred to in the figures with the reference number 3. The link frame portion 3 is connected to the upper and lower frame portions 1 and 2 by universal joints 4. The device is top mounted in suspending means 5.

The frame portions 1, 2, 3 are constituted by a number of bars or tubes 10, 11; 20, 21, 22, 23; 30, 31, 32, 33, 34. The upper frame portion 1 includes a right bar 10 and a left bar 11. These bars 10, 11 are generally in a vertical position. At the top end, the bars are provided with mounting means 51, 52, such as attachment rings, for connecting the hoist to a spreader bar 50 of the suspension means 5. This spreader bar 50 is suspended in a strap 53 by operating means, such as a winch moveable on an upper rail, a lifting structure or the like. The spreader bar 50 can be raised and lowered by the operating means.

At the lower end, the upper frame bars 10, 11 are connected to the link frame portion 3. The bars 10, 11 are preferably provided with bends for obtaining as smooth a transition as possible between the upper and the linkage frame portions 1, 3.

At the lower part of the upper frame bars 10, 11 attachment means 12 are provided for fitting a sling 9 to the upper frame portion 1. The sling extends around the back portions of the patient, and the patient is suspended in the sling whereby he or she is lifted or lowered in the hoist.

The linkage frame portion 3 includes a set of two generally parallel linkage bars 30, 31; 32, 33 on each side of the hoist. The two upper bars 30 and 33 of the two sets of bars are connected by a traverse bar 34. Hereby, good stability qualities of the hoist are provided. The traverse bar 34 is preferably connected to the upper bars 30, 33 in such a way that rotation of the traverse bar 34 is allowed around each of the upper bars 30, 33. Alternatively, the traverse bar could be rigidly connected to or integrally formed together with the upper bars 30, 33.

Similarly, the lower frame portion 2 similarly includes a left and a right frame bar portion 20, 21. The top part of these frame bars 20, 21 are provided with suitable bends similar to those of the lower part of the upper frame bars 10, 11 in order to obtain a smooth transition between the lower frame portion 2 and the linkage frame 3.

At the lower end of the lower frame portion 2, the bars 20, 21 are provided with generally horizontal bar portions 22, 23 between which a feet support 6 is provided. The feet support 6 may be in the form of a plate which is fixed between the left and the right bar 20, 22; 21, 23. The plate may preferably extend upwards following the bending of the bars, so as to create a front end 6*a* of the feet support plate 6.

Above the feet support 6, a knee support 7 is provided between the bars 20, 21. This knee support could be adjustable in at least the vertical position, so that the device may be adjusted to the individual size of a patient.

As mentioned above, these connections are made up by universal joints 4. The universal joints 4 are preferably provided with rubber sleeves so that smooth transitions between the relevant bars are provided in order to reduce the risk of injuries to a finger or a hand during operation of the hoist. Each of the universal joints 4 is freely pivotable in any direction. Stability of the frame is provided by the particular structure of the linkage frame 3. Preferably, the joints 4 are provided with some friction and a resting position via the rubber sleeves, where the two ends of a joint are aligned.

The lower frame portion 3 is provided with wheels 8 under the feet support 6. Hereby, the hoist can be supported from underneath during transport. This means that the patient is comfortably supported whilst in the device of a hoist.

As can be appreciated in FIG. 1, a patient is placed in the hoist with his/her feet on the feet support 6 and the knees abutting the knee support 7. The sling 9 is wrapped around the patient's back. The patient supports himself/herself by gripping around the upper bars 10, 11 or—as shown in FIG. 1—at the lower bars 31, 32 of the linkage frame portion 3. The operating means lifts the upper frame portion 1 of the hoist, the lower frame portion 2 remains resting on the floor, while the upper frame portion is moved upwards and the linkage frame portion 2 is swung upwards. Hereby, the patient is raised from a sitting position, such as from sitting in a wheelchair, to a standing position since the lower frame portion 1 is provided with wheels 8 under the feet support 6. The person can moreover be transported in the raised position.

A device according to a preferred embodiment of the invention is shown from different angles in FIGS. 2 to 4 without a person suspended therein. FIGS. 2 to 4 also show the hoist itself in different positions. An "unloaded" position where the joints are aligned is shown in FIG. 2. In FIG. 3, the device is shown in a raised position and in FIG. 4 in a lowered position. As can be appreciated from FIGS. 3 and 4, the lower frame portion 2 preferably remains resting on the floor on the wheels 8 whilst the upper frame portion is moved upwards or lowered by the suspension means in which the frame is suspended.

It is realised by the invention that the device can be used as a hoist without external lifting means with an actuator at the linkage frame portion. Hereby, no top mounting means is required. However, in order to maintain the option, the top mounting means could be provided on top of the hoist with an actuator, so that a hoist according to this embodiment may be used for external lifting arrangements when desired and as a "self-supporting" hoist when appropriate.

By the invention, it is realised that many different designs and alterations may be performed without departing from the scope of the invention as defined in the accompanying claims.

What is claimed is:

1. A device for handling a patient, such as raising the patient from a sitting position to a standing position or vice versa, and/or moving the person from one location to another, said device comprising top mounting means (51, 52) for suspending the device from suspension means (5), and frame means (1, 2, 3) for supporting the patient, said frame means comprising a supporting lower frame portion (2) comprising a feet support assembly (6) and a knee support (7), an upper frame portion (1) comprising the mounting means (51, 52) and means (12) for attaching a sling (9), and an intermediate frame linkage portion (3) connecting the upper and lower frame portions (1, 2) in such a way that the upper frame portion (1) is vertically moveable in relation to the lower frame portion (2).

2. A device according to claim 1, wherein the frame linkage portion (3) comprises at least one H- or U-shaped frame portion (30–34) comprising a right and a left bar portion.

3. A device according to claim 2, wherein the ends of the right and the left bar portions (30–33) are joined with the lower and the upper frame portion (1, 2), respectively.

4. A device according to claim 3, wherein the ends of the respective frame portions (10, 11; 20, 21; 30–33) are provided with universal joints (4) for linking the portions together.

5. A device according to claim 1, wherein the intermediate frame linkage portion (3) is designed as a parallelogram suspension allowing for a parallel movement between the lower frame portion (2) and the upper frame portion (1).

6. A device according to claim 1, wherein the feet support assembly (6) comprises a foot rest plate (6) and support roller means (8), disposed at the lowermost end of the lower frame portion (2) for supporting the device.

7. A device according to claim 1, wherein the knee support (7) is vertically adjustable.

8. A device according to claim 1, wherein the supporting lower frame portion (2) comprises a left and a right bar portion (20, 21).

9. A device according to claim 8, wherein the feet support (6) and/or the knee support (7) is/are attached between the two bar portions (20, 21).

10. A device according to claim 1, wherein the upper frame portion (1) is provided with hand grips between the top mounting means (51, 52) and the means (12) for attaching a sling (9).

11. A device according to claim 1, wherein the upper frame portion (1) comprises two side bars (10, 11).

12. A device according to claim 1, wherein the top mounting means (51, 52) and/or means (12) for attaching a sling (9) comprises attachment fittings at the top and the rear side of the upper frame portion (1), respectively.

13. A device according to claim 1, wherein the device is suspended from suspension means (5) comprising operating means for raising and lowering of the hoist and ceiling mounted track means in such a way that the device is movable in the track.

14. A device according to claim 13, wherein the operating means comprises a winch.

15. A device according to claim 1, wherein the device is suspended from suspension means (5) comprising a lifting lever with means (50, 53) for receiving the top mounting means (51, 52) of the device, said lifting lever being arranged in a vertically moveable manner in a chassis.

16. A device according to claim 15, wherein the chassis is provided with support wheels allowing for the device to be moved from one location to another while being suspended in the chassis.

* * * * *